US011695218B2

(12) United States Patent
Korva

(10) Patent No.: US 11,695,218 B2
(45) Date of Patent: Jul. 4, 2023

(54) ANTENNA ARRANGEMENT

(71) Applicant: NOKIA SOLUTIONS AND NETWORKS OY, Espoo (FI)

(72) Inventor: Heikki Tapani Korva, Tupos (FI)

(73) Assignee: NOKIA SOLUTIONS AND NETWORKS OY, Espoo (FI)

( * ) Notice: Subject to any disclaimer, the term of this patent is extended or adjusted under 35 U.S.C. 154(b) by 0 days.

(21) Appl. No.: 17/316,377

(22) Filed: May 10, 2021

(65) Prior Publication Data

US 2021/0351519 A1 Nov. 11, 2021

(30) Foreign Application Priority Data

May 11, 2020 (FI) ..... 20205470

(51) Int. Cl.
*H01Q 21/06* (2006.01)
*H01Q 9/04* (2006.01)
*H01Q 25/00* (2006.01)

(52) U.S. Cl.
CPC ..... *H01Q 21/065* (2013.01); *H01Q 9/0407* (2013.01); *H01Q 25/001* (2013.01)

(58) Field of Classification Search
CPC ..... H01Q 1/246; H01Q 1/52; H01Q 9/04; H01Q 9/0414; H01Q 9/0407; H01Q 9/0435; H01Q 9/045; H01Q 9/0457; H01Q 21/06; H01Q 21/061; H01Q 21/065
See application file for complete search history.

(56) References Cited

U.S. PATENT DOCUMENTS 4,208,660 A * 6/1980 McOwen, Jr. ..... H01Q 21/0075 343/789
4,543,579 A 9/1985 Teshirogi
4,843,400 A * 6/1989 Tsao ..... H01Q 21/065 343/700 MS
4,873,529 A 10/1989 Gibson
5,005,019 A * 4/1991 Zaghloul ..... H01Q 9/0414 166/270.1
5,043,738 A * 8/1991 Shapiro ..... H01Q 9/0435 343/700 MS
5,055,852 A * 10/1991 Dusseux ..... H01Q 9/0414 343/846
5,241,321 A * 8/1993 Tsao ..... H01Q 9/0435 343/848

(Continued)

FOREIGN PATENT DOCUMENTS

CA 2 540 216 A1 9/2007
CN 210296621 U 4/2020

(Continued)

OTHER PUBLICATIONS

Chen et al., "High Gain, Broadband and Dual-Polarized Substrate Integrated Waveguide Cavity-Backed Slot Antenna Array for 60 GHz Band", IEEE Access, vol. 6, (Jun. 11, 2018), pp. 31012-31022.

(Continued)

*Primary Examiner* — Jason Crawford
(74) *Attorney, Agent, or Firm* — Alston & Bird LLP

(57) ABSTRACT

An antenna arrangement is provided that includes a patch radiator, a feed arrangement, for the patch radiator and a cavity for the feed arrangement. The feed arrangement includes a slot in a conductive layer located between the patch radiator and the cavity.

19 Claims, 4 Drawing Sheets

(56) References Cited

U.S. PATENT DOCUMENTS

| | | | | |
|---|---|---|---|---|
| 5,539,420 | A * | 7/1996 | Dusseux | H01Q 9/0414 343/769 |
| 5,905,471 | A * | 5/1999 | Biebl | H01Q 1/3275 343/789 |
| 6,008,763 | A * | 12/1999 | Nystrom | H01Q 9/0457 343/848 |
| 6,054,953 | A * | 4/2000 | Lindmark | H01Q 9/0407 343/846 |
| 6,239,750 | B1 * | 5/2001 | Snygg | H01Q 5/40 343/846 |
| 6,462,710 | B1 * | 10/2002 | Carson | H01Q 21/065 343/770 |
| 6,531,984 | B1 * | 3/2003 | Johannisson | H01Q 9/0435 343/848 |
| 7,656,358 | B2 | 2/2010 | Haziza | |
| 7,986,279 | B2 * | 7/2011 | Bruno | H01Q 13/18 343/769 |
| 9,590,314 | B2 | 3/2017 | Celik | |
| 9,929,472 | B2 * | 3/2018 | Rojanski | H01Q 13/10 |
| 10,468,783 | B2 * | 11/2019 | Soodmand | H01Q 9/0428 |
| 2003/0043076 | A1 * | 3/2003 | Carson | H01Q 21/24 343/700 MS |
| 2011/0032164 | A1 | 2/2011 | Villarroel et al. | |
| 2013/0044035 | A1 * | 2/2013 | Zhuang | H01Q 9/0428 343/770 |
| 2014/0145891 | A1 * | 5/2014 | Palevsky | H01Q 9/0435 343/746 |
| 2015/0303576 | A1 * | 10/2015 | Latrach | H01Q 9/0464 343/700 MS |
| 2019/0260115 | A1 * | 8/2019 | Tehran | H01Q 21/065 |
| 2020/0313282 | A1 * | 10/2020 | Jia | H01Q 13/10 |
| 2020/0343648 | A1 * | 10/2020 | Tehran | H01Q 21/06 |
| 2021/0351519 | A1 * | 11/2021 | Korva | H01Q 9/0407 |

FOREIGN PATENT DOCUMENTS

| | | | |
|---|---|---|---|
| EP | 1 071 161 | A1 | 1/2001 |
| EP | 1357636 | A2 | 10/2003 |

OTHER PUBLICATIONS

Office Action and Search Report for Finland Application No. 20205470 dated Jan. 22, 2021, 7 pages.

Siddiqui et al., "A Differential Dual-Band Dual-Polarized Antenna for 5G mm Wave Communication System", 2020 2nd 6G Wireless Summit, (Mar. 17-20, 2020), 4 pages.

Extended European Search Report for European Application No. 21172762.3 dated Sep. 24, 2021, 11 pages.

* cited by examiner

ANTENNA ARRANGEMENT

CROSS-REFERENCE TO RELATED APPLICATIONS

This application claims priority to Finnish Application No. 20205470, filed May 11, 2020, the entire contents of which are incorporated herein by reference.

TECHNOLOGICAL FIELD

Embodiments of the present disclosure relate to an antenna arrangement. Some relate to a dual linear-polarized antenna arrangement.

BACKGROUND

Dual linear-polarized antenna arrangements often comprise a first dipole radiator oriented in a first polarization direction and a second dipole radiator oriented in a second polarization direction which is orthogonal to the first polarization direction.

It can be difficult to simultaneously optimize the antenna arrangement so that S-parameters have a suitably large bandwidth at a target frequency and there is sufficient isolation between the radiators.

The problem can be even greater in arrays of dual linear-polarized antenna arrangements that are use for beam steering, as sufficient isolation needs to be maintained across a range of beam steering angles.

BRIEF SUMMARY

According to various, but not necessarily all, embodiments there is provided an antenna arrangement comprising:

a patch radiator;

a feed arrangement, for the patch radiator; and a cavity for the feed arrangement, wherein the feed arrangement comprises a slot in a conductive layer located between the patch radiator and the cavity.

In some but not necessarily all examples, the feed arrangement comprises at least two feed conductors arranged adjacent the conductive layer wherein each of the feed conductors extend over different portions of the slot.

In some but not necessarily all examples, the feed conductors extends across the slot in a direction perpendicular to the slot, and wherein the feed conductors have different orientations In some but not necessarily all examples, the feed conductors have different orientations that are mutually offset by 90°.

In some but not necessarily all examples, the slot is galvanically separated from the patch radiator.

In some but not necessarily all examples, the feed arrangement comprises a first pair of feed conductors that extend over different portions of the slot, are aligned and are oriented in a first direction and wherein the feed arrangement comprises a second pair of feed conductors that extend over different portions of the slot, are aligned and are oriented in a second direction that is orthogonal to the first direction.

In some but not necessarily all examples, the feed arrangement is a balanced feed arrangement wherein at an operational frequency band, conductive interconnects to the first pair of feed conductors, of different lengths, introduce a 180° phase difference between the first pair of feed conductors which are connected as open-circuit and conductive interconnects to the second pair of feed conductors, of different lengths, introduce a 180° phase difference between the second pair of feed conductors.

In some but not necessarily all examples, the conductive layer is planar.

In some but not necessarily all examples, the slot is an elongate slot that forms a closed loop.

In some but not necessarily all examples, the slot is sinuous comprising multiple bends of different handedness.

In some but not necessarily all examples, the patch radiator is rotationally symmetric.

In some but not necessarily all examples, the patch radiator has a first dimension in a first direction that corresponds to half a wavelength at an operational frequency band of the antenna arrangement and has a second dimension in a second direction that corresponds to half a wavelength at the operational frequency band of the antenna arrangement.

In some but not necessarily all examples, the patch radiator has a three-dimensional shape.

In some but not necessarily all examples, one of an exterior perimeter of the patch radiator and an exterior perimeter of the slot are circular.

In some but not necessarily all examples, a base station comprises an array of antenna arrangements.

According to various, but not necessarily all, embodiments there is provided examples as claimed in the appended claims.

BRIEF DESCRIPTION

Some examples will now be described with reference to the accompanying drawings in which.

DETAILED DESCRIPTION

Figure 1A:
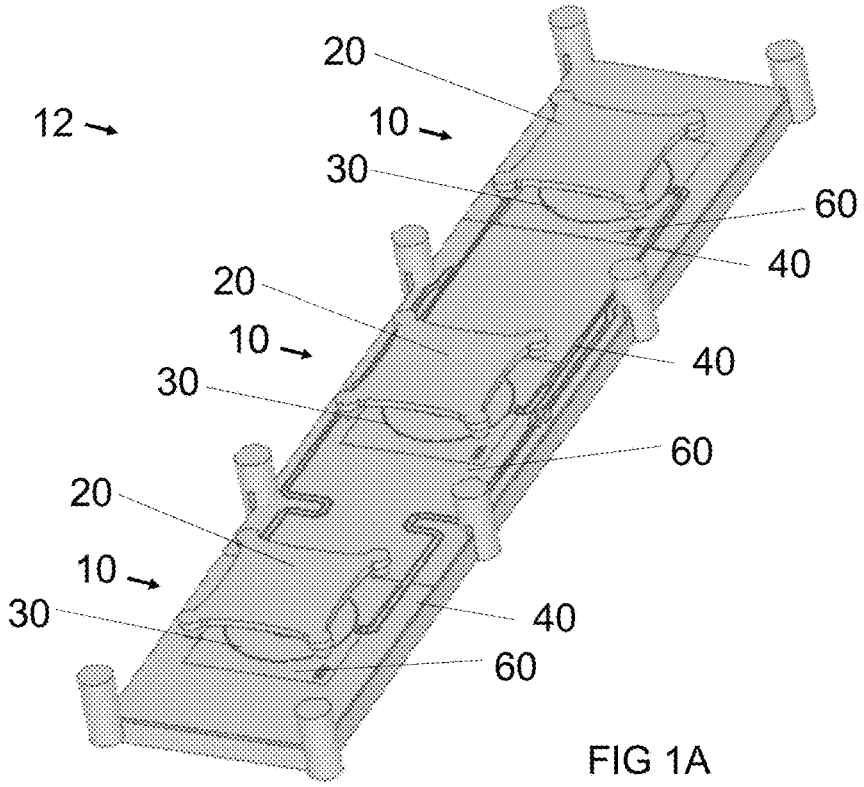
FIG. 1A shows an example of the subject matter described herein.

The FIGs illustrate examples of an antenna arrangement 10 comprising:

a patch radiator 20; a feed arrangement 40, for the patch radiator 20; and a cavity 50 for the feed arrangement 40.

The feed arrangement 40 comprises a slot 30 in a conductive layer 60. The slot 30 is located between the patch radiator 20 and the cavity 50.

The slot 30 is a through aperture that extends through the conductive layer 60. The slot is an elongate aperture. It is much longer than it is wide.

The antenna arrangement 10 can be used for transmission of far field radio waves and/or reception of far field radio waves.

In some examples, an antenna system 12 comprises an array 12 of antenna arrangements 10.

Figure 1B:
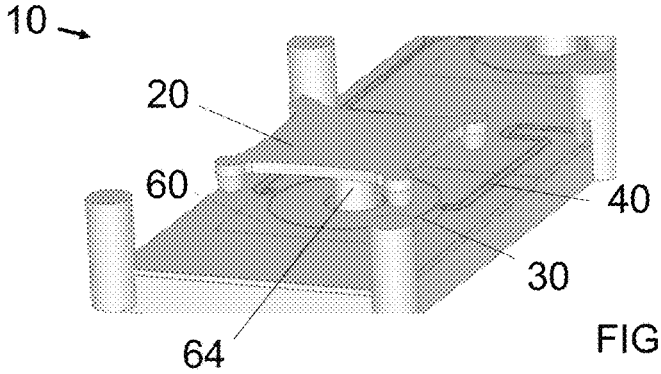
FIG. 1B shows another example of the subject matter described herein.

FIG. 1A illustrates, in perspective view, an array 12 of antenna arrangements 10. FIG. 1B illustrates one of those antenna arrangements 10. FIG. 1B illustrates the antenna arrangement 10 of FIG. 1B without the conductive layer 60, exposing the cavity 50.

Figure 2A:
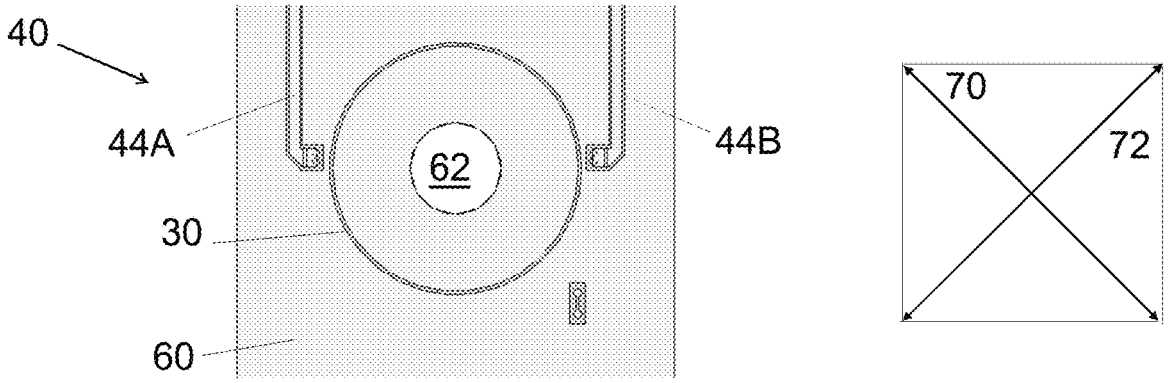
FIG. 2A shows another example of the subject matter described herein.
Figure 2B:
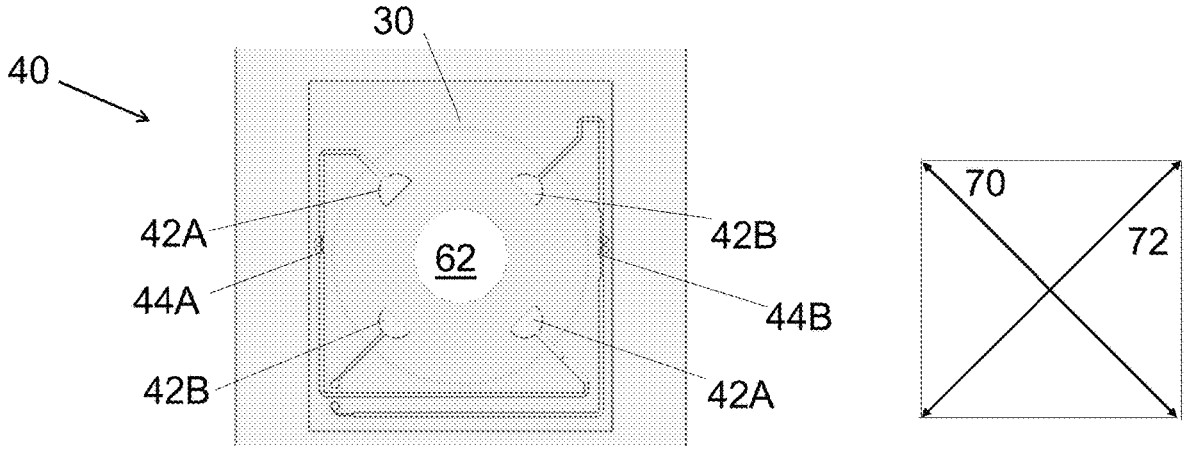
FIG. 2B shows another example of the subject matter described herein.

FIGS. 2A and 2B illustrate a feed arrangement 40 suitable for an antenna arrangement 10, for example, the antenna arrangement 10 of FIG. 1B. FIG. 2A and FIG. 2B illustrate opposing sides of the conductive layer 60.

Figure 3A:
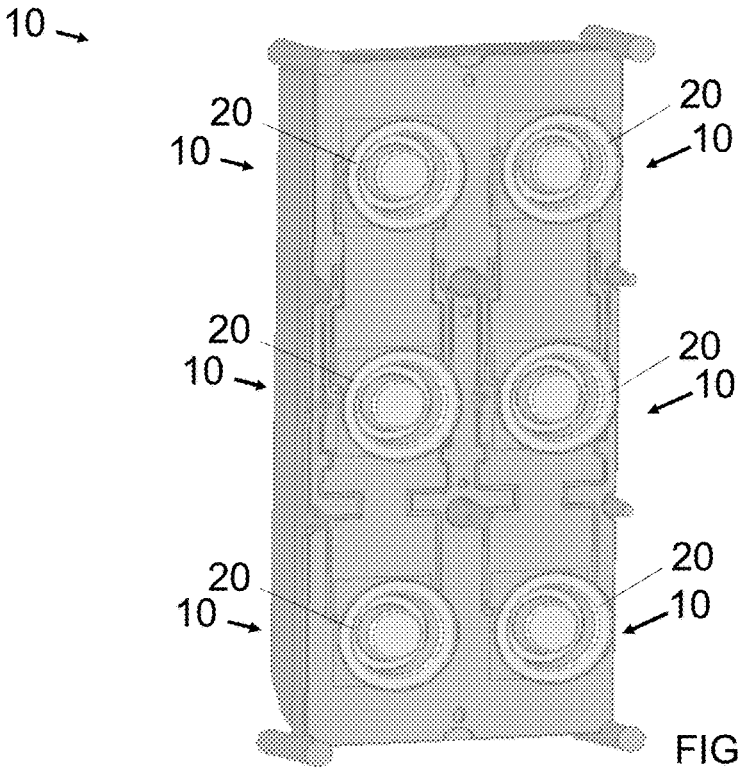
FIG. 3A shows another example of the subject matter described herein.
Figure 3B:
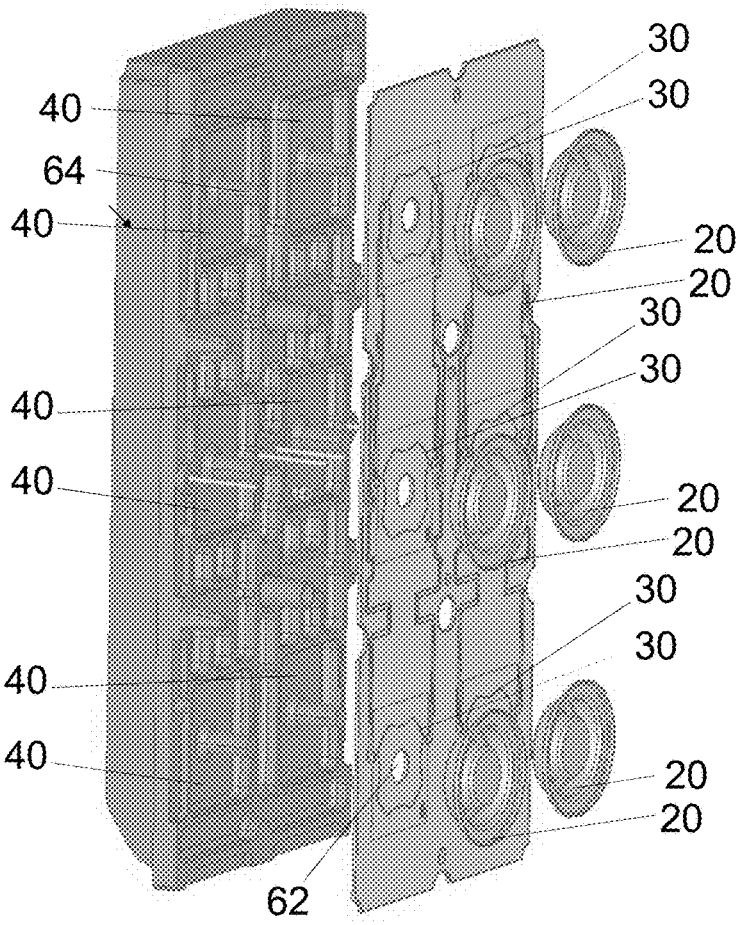
FIG. 3B shows another example of the subject matter described herein.
Figure 4:
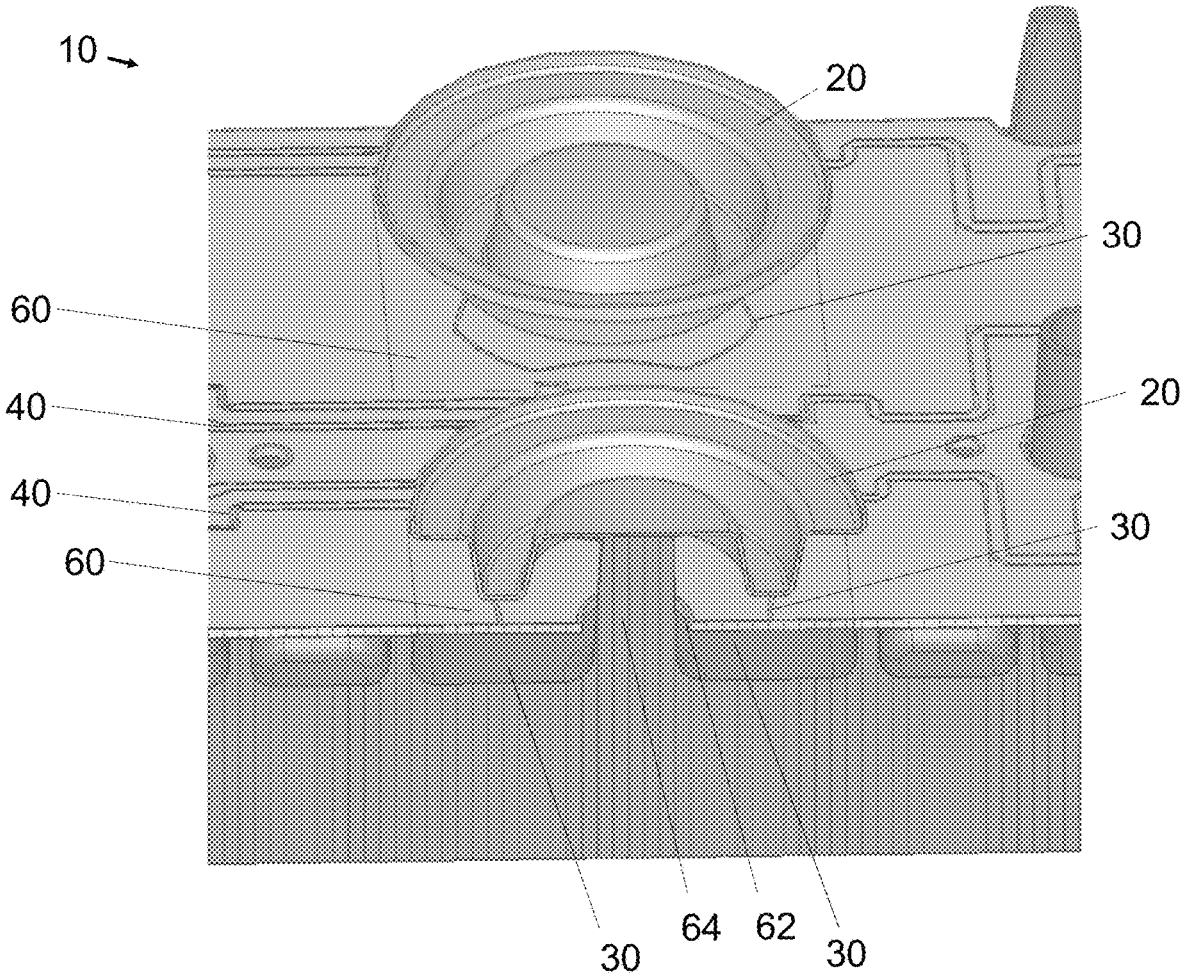
FIG. 4 shows another example of the subject matter described herein.

FIG. 3A illustrates, in perspective view, another array 12 of antenna arrangements 10. FIG. 3B illustrates an exploded view of the array 12 of antenna arrangements 10 illustrated in FIG. 3A. FIG. 4 illustrates in perspective cross-sectional view one of the antenna arrangements 10 of FIGS. 3A and 3B.

Figure 5:
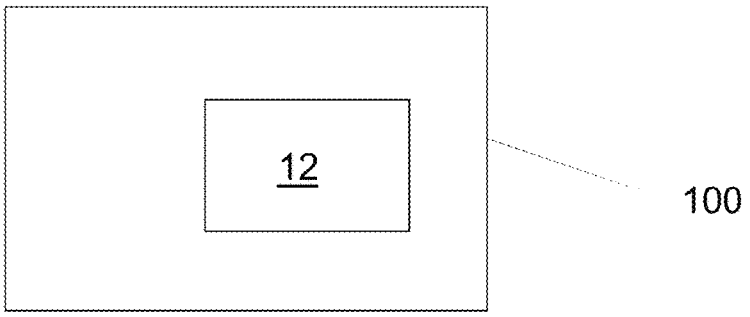
FIG. 5 shows another example of the subject matter described herein.

FIG. 5 illustrates a base station 100 that comprises an array 12 of antenna arrangements 10.

In these examples, the antenna arrangements 10 have dual linear polarization. The feed arrangement 40 is dual polarized and comprises at least two feed conductors 42A, 42B one for each orthogonal linear polarization. The feed conductors 42A, 42B are arranged adjacent the conductive layer 60. As illustrated in FIGS. 2A and 2B each of the feed conductors 42A, 42B extends over different portions of the slot 30. The feed conductors 42A, 42B overlap the slot and extend across both an exterior perimeter of the slot and an interior perimeter of the slot.

In some but not necessarily all examples, the feed conductors 42A, 42B extends across the slot 30 in a direction perpendicular to the slot 30. However, other angles may be possible.

In some but not necessarily all examples, the feed conductors 42A, 42B have different orientations that are mutually offset by 90°.

In the examples illustrated, the feed arrangement 40 comprises a first pair of feed conductors 42A that extend over different opposing portions of the slot 30. The first pair of feed conductors 42A are aligned and are oriented in a first direction 70. The feed arrangement 40 also comprises a second pair of feed conductors 42B that extend over different opposing portions of the slot 30. The second pair of feed conductors 42B are aligned and are oriented in a second direction 72 that is orthogonal to the first direction 70.

The feed arrangement 40 can be a balanced feed arrangement 40. First conductive interconnects 44A couple to the first pair of feed conductors 42A. The first conductive interconnects 44A are of different physical (and electrical) length, and are configured to introduce, at an operational frequency band, a 180° phase difference between the first pair of feed conductors 42A. Each of the first pair of feed conductors 42A can terminate in an open-circuit impedance (high impedance). Second conductive interconnects 44B couple to the second pair of feed conductors 42B. The second conductive interconnects 44B are of different physical (and electrical) length, and are configured to introduce, at the operational frequency band, a 180° phase difference between the second pair of feed conductors 42B which are connected as open-circuit.

This balanced feed, for each of the dual linear polarizations, provides better isolation between the polarizations.

The conductive layer 60 can be grounded (earthed) and form a ground plane. The conductive layer 60 can be a ground plane or part of a larger ground plane.

The conductive layer 60 can for example be provided as a planar layer and can be supported by a dielectric substrate.

The conductive layer 60 can for example be provided as a printed circuit board (PCB).

In the example, illustrated in FIGS. 2A and 2B, a single first conductive interconnect 44A travels along one side of the PCB (FIG. 2A), then travels through a via in the PCB to the other side of the PCB where (FIG. 2B) it splits to provide the first conductive interconnects 44A of different lengths to the respective first pair of feed conductors 42A. Also a single second conductive interconnect 44B travels along one side of the PCB (FIG. 2A), then travels through a via in the PCB to the other side of the PCB where (FIG. 2B) it splits to provide the second conductive interconnects 44B of different lengths to the respective second pair of feed conductors 42B.

In some but not necessarily all examples, the side of the PCB that comprises the pairs of feed conductors 42A, 42B is the side furthest from the patch radiator 20 as is within the cavity 50.

The patch radiator 20 is slot-fed by the slot 30. The slot 30 itself radiates from beneath the patch radiator 20 to feed the patch radiator 20. This avoids soldering.

The slot 30 is long and narrow and curves round on its self to form a closed loop. In the examples illustrated, the slot has a constant width along its length. Its length is greater than 30 times its width.

The slot 30 has rotational symmetry. In the examples illustrated it has a shape with at least four degrees of rotational symmetry. That is, it is isomorphic under a rotation of 90° about a central point.

The patch radiator 20 is formed from conductive material. It can for example be formed from metal or from non-conductive substrate covered in conductive material. The non-conductive substrate can for example be formed from a non-conductive dielectric material, for example at least one of: plastic, FR4 PCB material, ceramic material, and other known RF-suitable dielectric materials.

The patch radiator 20 has rotational symmetry. In the examples illustrated it has a shape with at least four degrees of rotational symmetry. That it is isomorphic under a rotation of 90° about a central point.

The patch radiator 20 is sized to operate at an operational frequency band. It has a first dimension in the first direction 70 that corresponds to half a wavelength at the operational frequency band of the antenna arrangement 10 and has a second dimension in the second direction 72 that corresponds to half a wavelength at the operational frequency band of the antenna arrangement 10. The size of the first dimension and the second dimension can be the same.

The patch radiator 20 is supported by a support 64 that extends through an aperture 62 in the conductive layer 60 at a central location within an inner perimeter of the slot 30.

The support 64 in the examples illustrated is a post that extends upwards from a base of the cavity 50. It is connected to the center of the patch radiator 20. This connection can be galvanic (electrically conductive of direct current) or isolated (electrically insulated). The support 64 can for example be formed from a block of conductive material, such as metal that has material removed to form the cavity 50. The centre position of the support with respect to the patch radiator 20 grounds the patch radiator but, because of its central location, in a way that does not affect the operation of the patch radiator 20.

The cavity 50 is a grounded conductive cavity. It can, for example, be formed in a metal or conductive base. The base can, for example, be formed from die cast aluminium. Alternatively, the cavity can be formed by coating a non-conductive substrate in conductive material. The non-conductive substrate can for example be formed from a non-conductive dielectric material, for example at least one of: plastic, FR4 PCB material, ceramic material, and other known RF-suitable dielectric materials. In some examples, stacked PCBs could be used to define the cavity 50. A lower grounded PCB could, for example, provide a base of the cavity 50. Upper grounded PCB or PCBs, which is/are stacked on top of the lower PCB and affixed thereto, could have a cut-out area that defines the sidewalls of the cavity 50 by creating a via.

The patch radiator 20 can enclose the cavity 50.

The cavity 50 can be sized and shaped to operate as a reflector for the slot 30. There can, for example, be a distinct cavity 50 for each slot 30.

The cavity 50 is relatively shallow. It can for example have a depth between ⅛ and ¼ of a wavelength at the operational frequency band of the antenna arrangement 10. This may correspond to a depth of a few mm in some examples.

Figure 1C:
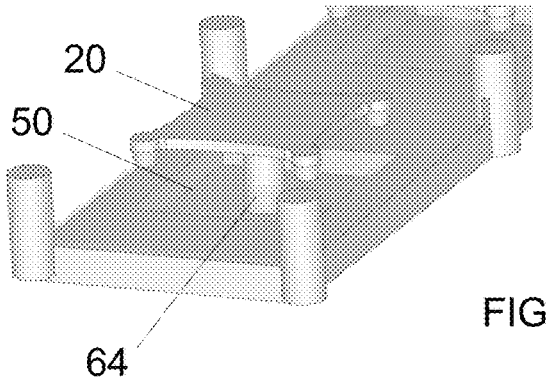
FIG. 1C shows another example of the subject matter described herein.

In the FIGs, the example illustrated in FIGS. 1A, 1B, 1C and the example illustrated in FIGS. 3A, 3B, 4 have some common properties as described above.

Also, in each of the examples, one of the patch radiator 20 and the slot 30 has an exterior perimeter that is circular and the other one of the patch radiator 20 and the slot 30 has an exterior perimeter that has four degrees of rotational symmetry.

In the example illustrated in FIGS. 1A, 1B, 1C the slot 30 has an exterior (and interior) perimeter that is circular and the patch radiator 20 has an exterior perimeter that is non-circular and has four degrees of rotational symmetry. In this example, the patch radiator is a two-dimensional shape being shaped in two-dimensions but not the third dimension.

In the example illustrated in FIGS. 3A, 3B, 4 the patch radiator 20 has an exterior perimeter that is circular and the slot 30 has an exterior (and interior) perimeter that is non-circular and has four degrees of rotational symmetry. In this example, patch radiator 20 is a three-dimensional shape. The slot 30 lies in a two-dimensional plane. The slot 30 is sinuous comprising multiple bends of different, alternating handedness. This allows a greater length of slot 30 to enclose a smaller area. The curved/meandering shape of the closed-loop slot 30 provides sufficient electrical length at the operational frequency band to achieve isolation between feed conductors 42A, 42B.

FIG. 5 illustrates an example of a base station comprising an antenna arrangement 10, for example, it can comprise an array 12 of antenna arrangements 10 as previously described.

The array 12 of antenna arrangements 10 can in some examples be configured for operation as active antennas that perform digital beamforming and beam steering. The array 12 of antenna arrangements 10 is suitable for massive multiple-input multiple-output (mMIMO) operation.

The array 12 of antenna arrangements 10 can in some examples be configured for digital beam steering at a wide operational bandwidth below 6 GHz. The beam steering can, for example, steer at least +/−60° from the boresight in the azimuthal (horizontal) direction and at least +/10° from the boresight in the polar (vertical) direction.

The cross-polar discrimination can, for example, be >20 dB at boresight and >10 dB over the whole steering range.

The antenna arrangements 10 described have good side lobe suppression at extreme steering angles because the antenna arrangements 10 have wide half power beamwidth. This same array gain can be obtained on sector edges with less beamsteering.

Where a structural feature has been described, it may be replaced by means for performing one or more of the functions of the structural feature whether that function or those functions are explicitly or implicitly described.

The operational frequency band may be within or cover a low band (0.7 to 0.96 GHz), a high band (1.7 to 2.7 GHz) or a very high band (3.3 to 3.8 GHz).

The operational frequency band may be within or cover 400-10 GHz. The operational frequency band may be within or cover 2500-2690 MHz. The operational frequency band may be within or cover 3400-3800 MHz.

The operational frequency bands, for example the first frequency band, the second frequency band and the third frequency band may be within or cover (but are not limited to) Long Term Evolution (LTE) (US) (734 to 746 MHz and 869 to 894 MHz), Long Term Evolution (LTE) (rest of the world) (791 to 821 MHz and 925 to 960 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US—Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting—handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz) and frequency bands for 5G.

A frequency band over which an antenna can efficiently operate is a frequency range where the antenna's return loss is less than an operational threshold 64. For example, efficient operation may occur when the antenna's return loss S11 is better than (that is, less than) −15 dB.

An operational bandwidth may be defined as where the return loss S11 is better than an operational threshold T such as, for example, −15 dB.

As used here 'module' refers to a unit or apparatus that excludes certain parts/components that would be added by an end manufacturer or a user.

The array 12 of antenna arrangements 10 can be a module. An antenna arrangement 10 can be a module.

The above described examples find application as enabling components of:

automotive systems; telecommunication systems; electronic systems including consumer electronic products; distributed computing systems; media systems for generating or rendering media content including audio, visual and audio visual content and mixed, mediated, virtual and/or augmented reality; personal systems including personal health systems or personal fitness systems; navigation systems; user interfaces also known as human machine interfaces; networks including cellular, non-cellular, and optical networks; ad-hoc networks; the internet; the internet of things; virtualized networks; and related software and services.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . ." or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although examples have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain examples, those features may also be present in other examples whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer any exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

I claim:

1. An antenna arrangement comprising:

a patch radiator;

a feed arrangement, for the patch radiator; and a cavity for the feed arrangement, wherein the feed arrangement comprises an elongate slot, forming a closed loop, in a conductive layer located between the patch radiator and the cavity, and wherein the slot is sinuous comprising multiple bends of different handedness.

2. An antenna arrangement as claimed in claim 1, wherein the feed arrangement comprises at least two feed conductors arranged adjacent the conductive layer wherein each of the feed conductors extend over different portions of the slot.

3. An antenna arrangement as claimed in claim 2, wherein the feed conductors extends across the slot in a direction perpendicular to the slot, and wherein the feed conductors have different orientations.

4. An antenna arrangement as claimed in claim 2, wherein the feed conductors have different orientations that are mutually offset by 90°.

5. An antenna arrangement as claimed in claim 1, wherein the slot is galvanically separated from the patch radiator.

6. An antenna arrangement as claimed in claim 1, wherein the feed arrangement comprises a first pair of feed conductors that extend over different portions of the slot, are aligned and are oriented in a first direction and wherein the feed arrangement comprises a second pair of feed conductors that extend over different portions of the slot, are aligned and are oriented in a second direction that is orthogonal to the first direction.

7. An antenna arrangement as claimed in claim 6, wherein the feed arrangement is a balanced feed arrangement wherein at an operational frequency band, conductive interconnects to the first pair of feed conductors, of different lengths, introduce a 180° phase difference between the first pair of feed conductors which are connected as open-circuit and conductive interconnects to the second pair of feed conductors, of different lengths, introduce a 180° phase difference between the second pair of feed conductors.

8. An antenna arrangement as claimed in claim 1, wherein the conductive layer is planar.

9. An antenna arrangement as claimed in claim 1, wherein the patch radiator is rotationally symmetric.

10. An antenna arrangement as claimed in claim 1, wherein the patch radiator has a first dimension in a first direction that corresponds to half a wavelength at an operational frequency band of the antenna arrangement and has a second dimension in a second direction that corresponds to half a wavelength at the operational frequency band of the antenna arrangement.

11. An antenna arrangement as claimed in claim 1, wherein the patch radiator has a three-dimensional shape.

12. An antenna arrangement as claimed in claim 1, wherein one of an exterior perimeter of the patch radiator and an exterior perimeter of the slot are circular.

13. A base station comprising an array of antenna arrangements, wherein at least one of the array or antenna arrangements comprises:

a patch radiator;

a feed arrangement, for the patch radiator; and a cavity for the feed arrangement, wherein the feed arrangement comprises an elongate slot, forming a closed loop, in a conductive layer located between the patch radiator and the cavity, and wherein the slot is sinuous comprising multiple bends of different handedness.

14. A base station as claimed in claim 13, wherein the feed arrangement of the at least one of the array of antenna arrangements comprises at least two feed conductors arranged adjacent the conductive layer, and wherein each of the feed conductors extend over different portions of the slot.

15. A base station as claimed in claim 13, wherein the feed arrangement of the at least one of the array of antenna arrangements comprises a first pair of feed conductors that extend over different portions of the slot, are aligned and are oriented in a first direction and wherein the feed arrangement comprises a second pair of feed conductors that extend over different portions of the slot, are aligned and are oriented in a second direction that is orthogonal to the first direction.

16. A base station as claimed in claim 15, wherein the feed arrangement is a balanced feed arrangement wherein at an operational frequency band, conductive interconnects to the first pair of feed conductors, of different lengths, introduce a 180° phase difference between the first pair of feed conductors which are connected as open-circuit and conductive interconnects to the second pair of feed conductors, of different lengths, introduce a 180° phase difference between the second pair of feed conductors.

17. A base station as claimed in claim 13, wherein the patch radiator of the at least one of the array of antenna arrangements has a first dimension in a first direction that corresponds to half a wavelength at an operational frequency band of the at least one of the array of antenna arrangements and has a second dimension in a second direction that corresponds to half a wavelength at the operational frequency band of the at least one of the array of antenna arrangements.

18. A base station as claimed in claim 13, wherein one of an exterior perimeter of the patch radiator and an exterior perimeter of the slot are circular.

19. An antenna arrangement comprising:

a patch radiator;

a feed arrangement for the patch radiator; and a cavity for the feed arrangement, wherein the feed arrangement comprises a slot in a conductive layer located between the patch radiator and the cavity, wherein the feed arrangement comprises (i) a first pair of feed conductors, of different lengths, that extend over different portions of the slot, and are aligned and oriented in a first direction and (ii) a second pair of feed conductors, of different lengths, that extend over different portions of the slot, and are aligned and oriented in a second direction that is orthogonal to the first direction, wherein the feed arrangement comprises a balanced feed arrangement, and wherein at an operational frequency band, conductive interconnects to the first pair of feed conductors introduce a 180° phase difference between the first pair of feed conductors, which are connected as open-circuit, and conductive interconnects to the second pair of feed conductors introduce a 180° phase difference between the second pair of feed conductors.

* * * * *